US009163472B2

(12) United States Patent
Childers et al.

(10) Patent No.: US 9,163,472 B2
(45) Date of Patent: Oct. 20, 2015

(54) EXTENDABLE CONDUCTOR STAND HAVING MULTI-STAGE BLOWOUT PROTECTION

(71) Applicants: Travis Childers, Joseph, UT (US); C. J. Childers, Richfield, UT (US); Eli Childers, Glenwood, UT (US); William D. Cameron, Magnolia, TX (US)

(72) Inventors: Travis Childers, Joseph, UT (US); C. J. Childers, Richfield, UT (US); Eli Childers, Glenwood, UT (US); William D. Cameron, Magnolia, TX (US)

( * ) Notice: Subject to any disclaimer, the term of this patent is extended or adjusted under 35 U.S.C. 154(b) by 306 days.

(21) Appl. No.: 13/621,284

(22) Filed: Sep. 16, 2012

(65) Prior Publication Data

US 2014/0076532 A1 Mar. 20, 2014

(51) Int. Cl.

| | |
|---|---|
| ***E21B 33/06*** | (2006.01) |
| ***E21B 41/00*** | (2006.01) |
| ***E21B 17/00*** | (2006.01) |
| ***E21B 17/07*** | (2006.01) |

(52) U.S. Cl.

CPC ..... *E21B 33/06* (2013.01); *E21B 17/00* (2013.01); *E21B 17/07* (2013.01); *E21B 41/0021* (2013.01)

(58) Field of Classification Search

CPC ..... E21B 17/00; E21B 17/07; E21B 33/06; E21B 41/0021

USPC ..... 166/355, 379, 358, 380, 85.4; 175/7; 285/302

See application file for complete search history.

(56) References Cited

U.S. PATENT DOCUMENTS

| | | | | |
|---|---|---|---|---|
| 3,465,817 | A * | 9/1969 | Vincent | 166/355 |
| 4,367,981 | A * | 1/1983 | Shapiro | 405/224.2 |
| 4,524,832 | A * | 6/1985 | Roche et al. | 166/347 |
| 4,597,447 | A * | 7/1986 | Roche et al. | 166/347 |
| 4,646,844 | A * | 3/1987 | Roche et al. | 166/379 |
| 5,069,488 | A * | 12/1991 | Freyer et al. | 285/302 |
| 5,211,228 | A * | 5/1993 | Watkins | 166/84.1 |
| 8,033,335 | B2 * | 10/2011 | Orbell et al. | 166/367 |
| 8,733,447 | B2 * | 5/2014 | Mouton et al. | 166/355 |
| 8,752,637 | B1 * | 6/2014 | Childers | 166/380 |
| 2006/0157236 | A1 * | 7/2006 | Walker et al. | 166/85.4 |
| 2008/0251257 | A1 * | 10/2008 | Leuchtenberg | 166/355 |
| 2008/0264626 | A1 * | 10/2008 | Patton | 166/77.2 |
| 2012/0261138 | A1 * | 10/2012 | Zhou | 166/379 |

* cited by examiner

*Primary Examiner* — Daniel P Stephenson
(74) *Attorney, Agent, or Firm* — J. Todd Rushton

(57) ABSTRACT

An extendable conductor stand allowing for rapid alignment and installation. The conductor stand having capacity to accept a BOP to protect against all blowouts, including behind the casing blowouts.

6 Claims, 3 Drawing Sheets

EXTENDABLE CONDUCTOR STAND HAVING MULTI-STAGE BLOWOUT PROTECTION

BACKGROUND

Drilling for oil or gas is a complicated and dangerous endeavor where drillers must blend both technology and experience to create a working well. The early stages of the well development are the most critical and due to the lack of blow-out protection, it is also the most hazardous period for the crew working the rig.

Setup for drilling an oil or gas borehole will vary depending upon location and ground conditions. However, in most circumstances, the first step is to install a relatively short string of large diameter conductor pipe. The conductor pipe will act as a drilling guide and prevents unconsolidated surface material from collapsing into the borehole. The pipe may be 120 feet long for an on surface development or a much longer string in an underwater drilling. In other applications, where the surface material has allowable cohesive properties, the operator will first drill an oversized hole using an auger prior to inserting the conductor pipe into the hole and then cementing the space between the outside of the conductor pipe wall and original hole. Once the conductor pipe is in place, the operator will prepare and level the pipe end by cutting and/or grinding. Additional sections of pipe will be welded onto the conductor to properly position the top flange with the drilling platform and to accept a top-drive head. A drilling fluid flow line attached to the conductor string must also be properly aligned to allow connection with a corresponding system on the drill platform. Leveling and positioning the top of the conductor pipe is call "nippling up"; the process is time consuming, typically requiring 12 to 14 hours.

The next step is to "drill for surface" or drill a smaller hole through the conductor pipe, preparatory for setting the borehole casing. The depth of the surface hole will vary depending on the depth of the ultimate target, ground conditions and other factors. However, this step may be the most perilous; and the shallower the bore, the greater the danger to the men and equipment. During the drilling process it is common for the drill hole to intercept gas pockets of methane or hydrogen sulfide in the rock or the coal formation being penetrated, the gases can be under extremely high pressure and are flammable. Drilling fluid or drilling "mud" is a mixture of water, clay and myriad other ingredients; the mud is injected under pressure down the center of the drill string, and as the mud recirculates back to the surface, on the outside of the drill string, the mud carries the rock cuttings out of the hole and serves to condition and seal the walls of the bore. Additionally, a driller may adjust the specific density of the drilling mud to increase hydrostatic pressure and help to control the flow of formation gas to the surface. However, if gas is encountered at shallow depth and the hydrostatic pressure of the drilling fluid in the vertical bore column is insufficient to overcome the pressure of the formation gas, the gas will blowout the top of the borehole at high speed, potentially causing equipment damage and injury, and if the gas is flammable, the danger of an explosion and fire is also present.

Once "surface" has been set, a casing string will be inserted, through the conductor, into the borehole and cemented into place. The cement will fill the void between the casing and the borehole and the space between the casing and the conductor. The casing can then be fitted with a BOP or blowout preventer. The BOP, as commonly known in the art, may be a ram or shear arrangement that blocks the well bore in the case of escaping gas or fluid. However, a BOP will not protect the drilling platform and crew until the casing is installed and they cannot protect the crew in the situation of a "behind casing blowout".

A behind casing blowout occurs when gas escapes towards the drill platform between the casing and conductor. This may occur because the pressure wave from the escaping gas shocks the casing wall, fracturing or separating the cement between the casing and the conductor. It is also postulated that the differential of thermal expansion between the steel and cement creates separations or channels where high pressure gas can pass through.

What is needed, is a device that can be quickly installed, that will protect the drill platform and crew during the early startup stages, and can protect against a behind the casing blowout.

SUMMARY OF THE INVENTION

The present invention is an extendable conductor stand having blowout protection. The extendable conductor stand includes two sections of pipe, the bottom section most commonly will be the same diameter as the conductor string, and the top section is a smaller diameter, which will nest inside of the bottom section. For one embodiment, the top end of the top section and the bottom end of the bottom section will include a welded flange. In one embodiment, a seal arrangement is installed on the outside bottom diameter of the top section and will engage the inside diameter of the bottom section, the seal preserves the pressure integrity of the structure. The seal arrangement may be constructed as stacked fiber seals, o-rings, neoprene, rubber bushing or another known, or yet to be developed seal system. In yet another embodiment, a second seal arrangement is installed on the inside top diameter of the bottom section, providing a secondary seal for the assembly. The inside top edge of the bottom section includes a centering guide to align the top section inside of the bottom section. The centering guide may be configured as a bushing or spacer and constructed from a metallic material, such as aluminum, brass, or bronze or it may be constructed from a material such as nylon, high density polyethylene, or similar material. The bottom section will include a gas choke line having a safety valve and optional choke valve. The choke valve may be manual or may be a remotely actuated hydraulic or pneumatic valve. The top section will include a flow line nipple for drilling fluid discharge. The top section can be extended out of bottom section or "telescoped" to the necessary length for proper position on the drilling rig platform and for installation of the top drive. In one embodiment, the top conductor section includes a junction where one or more spool pieces, or extension sections, of conductor pipe can be inserted. In situations where the drilling platform is elevated due to equipment arrangements, topography, or if the platform is in water, the operator can extend the conductor stand near the drilling platform prior to making final adjustments to the stand by extending the top conductor section out of the base section. In one embodiment, the junction will be a bolted flange fitting and in yet another embodiment, the conductor pipe junction may be threaded, having a thread end and a box end.

In one embodiment, the bottom section will have an additional flanged junction, above the gas choke line, where one or more BOP assemblies, such as an, annular preventer, may be installed. This arrangement allows the users to control any blowout situation whether the gas propagates up the borehole through the casing or is a behind the casing event. In the event the BOP is closed due to gas discharge the choke valve can be used to control the gas flow out of the bore hole and to a flare stack where it can be safety burned off.

In yet another embodiment, one or more BOP assemblies may be installed in the junction of the top conductor pipe. The BOP assemblies may be installed with or without using an additional spool piece depending on the drilling platform height and application. It is contemplated to use a "two door" BOP assembly in the upper conductor section, where, the bottom door will have a "shear ram" to shear the drill string and the top door having a "blind ram" to seal the well bore and prevent any hydrocarbons from escaping.

In a situation where there is a total wellbore integrity failure, the well can be shut down by first closing the lower BOP or annual preventer, followed by the shear ram and blind ram in that order.

In another embodiment, a locking mechanism is installed between the bottom conductor stack section and the top conductor stack section. The locking mechanism will allow incremental extension of the assembly and prevent the top section from falling back into a lower position when lifting pressure is released. It is contemplated to configure the locking mechanism as a pawl, or conductor travel latch, configured to engage a vertical series of dogs welded to the outside surface of the top section. In another embodiment, the locking mechanism may be locking ring installed into a series of grooves in the outside surface of the top conductor section. In another embodiment, the locking mechanism may be a pin or pins installed into a series of vertical holes. In another embodiment, the locking mechanism may be one or more pawls attached to a sliding clamp on the top section that engage a series of cleats or dogs attached to the outside surface of the bottom section. In yet another embodiment, the locking mechanism may be a clamp or slip coupling that engages the outside diameter of the top conductor section.

In another embodiment, the top conductor section is rotatable inside of the bottom section. This arrangement allows for rapid alignment of the flow line nipple.

In each configuration, the present invention allows the user to significantly reduce the time required to connect the conductor casing with the drilling platform.

It is recognized that the effect of the invention may also be accomplished by inverting the configuration, where the bottom conductor section had the smaller diameter and was inserted into the top conductor section having in inside diameter larger than the outside diameter of the bottom conductor section.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWING

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAIL DESCRIPTION OF THE DRAWINGS

Figure 1:
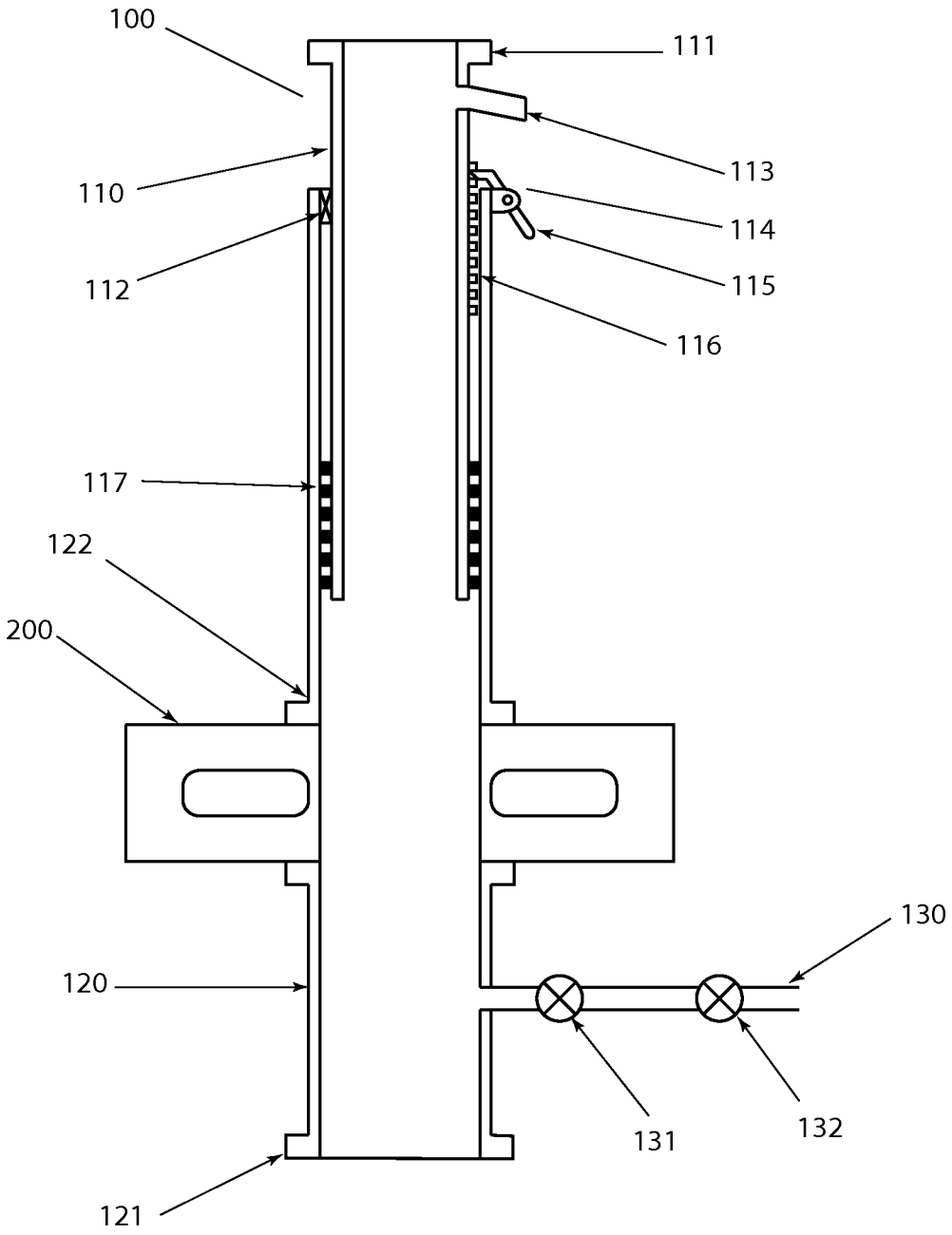
FIG. 1, is a section of the extendable conductor stand.

FIG. 1 is one embodiment of the present invention, or more specifically, an extendable conductor stand having blowout protection 100. The conductor stand 100 is comprised of two major sections of steel pipe, the top section 110 having a first diameter and a bottom section 120 having a second larger diameter, where a portion of the top section 110 can be inserted into the bottom section 120. The top end of the top section 110 having a welded flange 111 and a drilling fluid flow line nipple 113. The bottom end of the bottom section includes a welded flange 121. The sections are aligned using a centering guide 112 secured in the space between the outside diameter of the top section 110 and the inside diameter of the bottom section 120. The assembly of the top section 110 and bottom section 120 is pressure sealed by seal assembly 117. Seal assembly 117, may be stacked fiber seal rings or o-rings or may be a single neoprene, silicone, rubber, or similar material bushing block. Conductor stand 100 can be bolted into place on the conductor string using flange 121 and then the top section 110 can be extended to proper level on the drilling rig platform. In another embodiment, it is contemplated to include at least a second 112 positioned below the seal assembly 117.

The bottom conductor section 120 includes a blowout protection device mounting junction 122 where one or more BOPs 200 can be installed in the system. The BOP 200 can be an annular preventer, single ram, double ram or gate type device. In addition, the bottom conductor section 120 includes a gas choke line 130, having a primary safety valve 131 and a secondary valve 132 is used to safely bleed excess formation gas out of the borehole.

In one embodiment, extendable conductor stand 100 includes a conductor travel locking mechanism 114, having a travel lock lever 115 with catch dogs 116. In this configuration the top conductor section 110 will remain safely in a raised position even after the lifting force is removed. In another embodiment it is contemplated that the top section 110 will be handed and secured into a fixed position using a pneumatic, hydraulic or mechanical slip coupling (not shown) as commonly known in the art.

In another embodiment, the top section 110 is rotatable for easy alignment of the drilling fluid flow line nipple 113 with the associated piping on the drilling rig.

Figure 2:
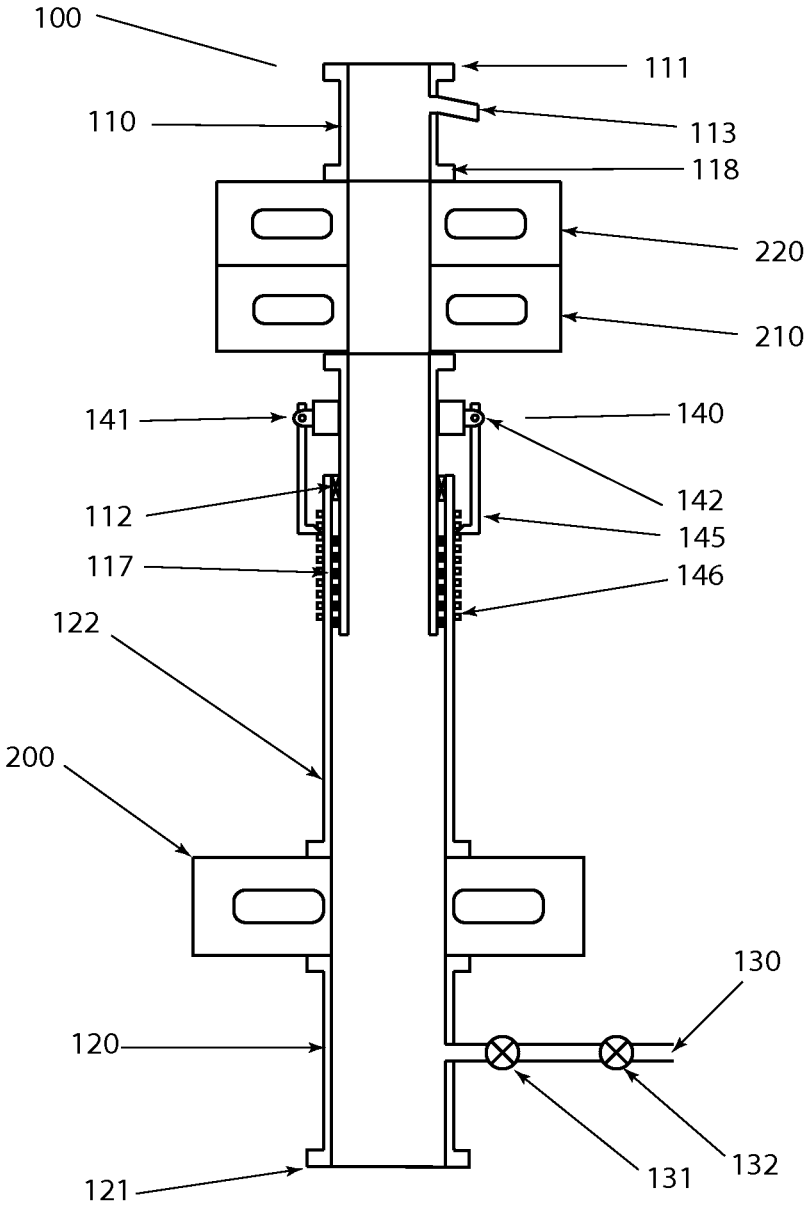
FIG. 2, is a second embodiment of the extendable conductor stand.
Figure 3A:
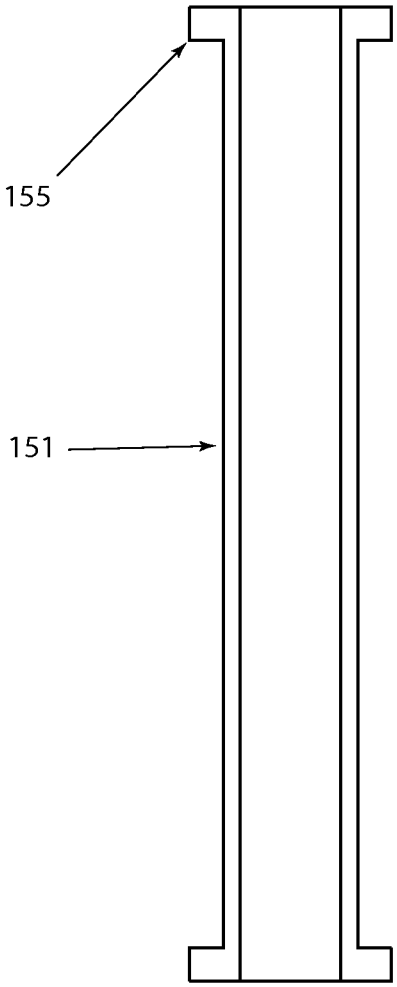
FIG. 3A, is a spool piece of a first length.
Figure 3B:
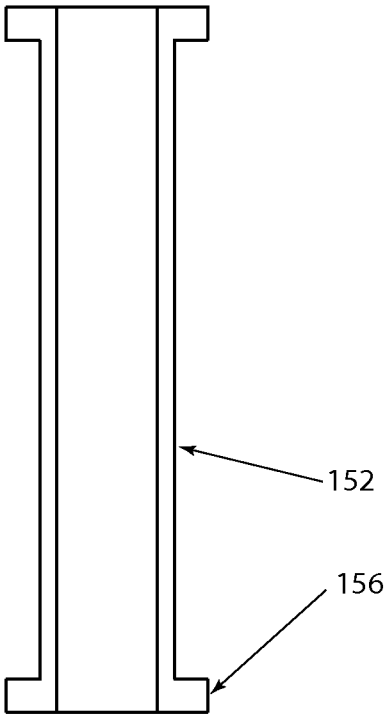
FIG. 3B, is a spool piece of a second length.

FIG. 2 is another embodiment of the present invention or extendable conductor stand 100, having the major components of the previous embodiments including, a top conductor section 110 which is movably inserted into a bottom conductor section 120. The top conductor section 110, includes a flanged spool junction 118, where one or more spool sections (151, 152, FIGS. 3A and 3B) may be inserted. The spool sections 151, 152 may be of different lengths, a set length or may be a custom length and can be bolted into the spool junction 118 with mating flanges 155, 156. This arrangement allows the operator to roughly fit the conductor stand 100 under an elevated drill platform prior to making final height adjustments using the telescoping feature. In one embodiment, the spool junction 118 may be threaded, allowing a flush finish with the outside diameter of the top conductor section 110 (not shown). It is contemplated that a threaded junction 118 will require gussets plates or rings welded into the end portions of each conductor pipe section; this will improve the integrity and durability of the threaded ends.

In yet another embodiment, one or more BOP assemblies 210, 220 may be inserted in the spool junction 118. It is contemplated to use a "two door" assembly having a shear ram 210 and blind ram 220.

The embodiment of FIG. 2 includes a conductor travel locking mechanism 140 located outside of the top conductor section 110/bottom conductor section 120 interface. Locking mechanism 140 includes, sliding conductor clamp 141, lever pivots 142, pawl levers 145, and cleat or dog sets 146. The sliding conductor clamp 141 allows the upper portion of the locking mechanism 140 to be adjusted on the top conductor section 110. The operator can extend the upper conductor section 110 to an approximate length, tighten the conductor clamp 141, and if the difference between the approximate length and the final length is within the range, or height, of the cleat set 146, the conductor stand 100 can be set at final height without repositioning the clamp 141. The alignment burden for the operator can be reduced by extending the height of the cleat set 146 and lengthening the pawl levers 145. Pawl levers 145 are spring biased toward an engaged position with cleats 146 and may include a locking pin or bolt for rigid engagement once proper height is attained. The cleats or dogs 146 have an extended length or contact area, allowing for partial rotation of the top conductor section 110 when aligning the flow line nipple 113. Locking mechanism 140 allows for increased travel of the top section 110, for a complete alignment bushing 112 and the installation of a secondary seal set if desired.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An extendable drilling conductor stand comprising:

a bottom conductor section having a first inside diameter;

a top conductor section having a second outside diameter smaller than the inside diameter of the bottom conductor section;

a portion of the top conductor section positioned inside of the bottom conductor section, wherein the top conductor section can be inserted into or extended out of the bottom conductor section, a seal assembly between the inside diameter of the bottom conductor section and the outside diameter of the top conductor section, and;

a conductor lock mechanism.

2. The drilling conductor stand of claim 1, wherein the conductor lock mechanism includes at least one pawl, having an attachment end and a catch end, attached to a pivot point on the top conductor section and a plurality of catch dogs, in a vertical arrangement, attached on the bottom conductor section.

3. The drilling conductor stand of claim 2, wherein the pivot point on the top conductor section is fixed.

4. The drilling conductor stand of claim 2, wherein the pivot point on the top conductor section is formed on a moveable clamp.

5. The drilling conductor stand of claim 2, where the pawl is biased into a locked position.

6. The drilling conductor stand of claim 1, wherein the conductor lock mechanism is a slip coupling.

* * * * *